US010488076B2

(12) United States Patent
Kim

(10) Patent No.: US 10,488,076 B2
(45) Date of Patent: Nov. 26, 2019

(54) FLUID CIRCULATION TYPE HEATING APPARATUS

(71) Applicant: Young Jung Kim, Seoul (KR)

(72) Inventor: Young Jung Kim, Seoul (KR)

( * ) Notice: Subject to any disclaimer, the term of this patent is extended or adjusted under 35 U.S.C. 154(b) by 564 days.

(21) Appl. No.: 15/106,484

(22) PCT Filed: Dec. 19, 2014

(86) PCT No.: PCT/KR2014/012559
§ 371 (c)(1),
(2) Date: Jun. 20, 2016

(87) PCT Pub. No.: WO2015/099360
PCT Pub. Date: Jul. 2, 2015

(65) Prior Publication Data

US 2016/0348942 A1 Dec. 1, 2016

(30) Foreign Application Priority Data

Dec. 23, 2013 (KR) ..... 10-2013-0161761

(51) Int. Cl.
*F24H 1/22* (2006.01)
*F24H 1/00* (2006.01)
(Continued)

(52) U.S. Cl.
CPC ..... *F24H 1/0018* (2013.01); *F24D 11/002* (2013.01); *F24H 1/22* (2013.01); *F24H 9/122* (2013.01)

(58) Field of Classification Search
CPC ..... F24H 1/0018; F24H 1/22; F24H 9/122; F24D 11/002
(Continued)

(56) References Cited

U.S. PATENT DOCUMENTS 4,406,794 A * 9/1983 Brigante ..... B03C 1/02 122/382
6,325,297 B1 * 12/2001 Calvin ..... F24H 1/08 237/12.3 B
(Continued)

FOREIGN PATENT DOCUMENTS

CN 102865619 A 1/2013
JP 62-134424 A 6/1987
(Continued)

OTHER PUBLICATIONS

Klm, Google Translated KR10-2009-0082986, 2009 (Year: 2009).*

*Primary Examiner* — Chee-Chong Lee
(74) *Attorney, Agent, or Firm* — Rabin & Berdo, P.C.

(57) ABSTRACT

A fluid circulation type heating apparatus includes: a circulation line; a heat radiation member installed on the circulation line; a boiler configured to heat and expand a fluid; a storage tank configured to store the fluid and to supply the fluid to the boiler; a controller configured to control the boiler; and a housing configured to accommodate the boiler and the controller. The apparatus further includes: a backflow prevention means removably installed in the housing and configured to, when mounted to the housing, communicate with the circulation line disposed between the boiler and the storage tank, the backflow prevention means configured to allow the fluid to flow in one direction through the circulation line.

9 Claims, 8 Drawing Sheets

(51) Int. Cl.
*F24H 9/12* (2006.01)
*F24D 11/00* (2006.01)

(58) Field of Classification Search
USPC ..... 392/458
See application file for complete search history.

(56) References Cited

U.S. PATENT DOCUMENTS

| | | | | |
|---|---|---|---|---|
| 6,739,517 | B1 * | 5/2004 | Krueger | F24D 3/1008 122/13.01 |
| 6,925,968 | B1 * | 8/2005 | Hwang | F22B 13/00 122/40 |
| 7,100,540 | B2 * | 9/2006 | Vaughan | A01M 15/00 122/40 |
| 2012/0204977 | A1 * | 8/2012 | Lembcke | E21B 43/123 137/511 |

FOREIGN PATENT DOCUMENTS

| | | | |
|---|---|---|---|
| JP | 2012-511693 | A | 5/2012 |
| KR | 10-0312643 | B1 | 12/2001 |
| KR | 10-0874279 | B1 | 12/2008 |
| KR | 10-2009-0082986 | A | 8/2009 |
| KR | 10-0969815 | B1 | 7/2010 |
| KR | 10-1033668 | B1 | 5/2011 |
| KR | 10-1038576 | B1 | 6/2011 |
| KR | 10-2012-0068221 | A | 6/2012 |
| KR | 10-1243865 | B1 | 3/2013 |

* cited by examiner

FLUID CIRCULATION TYPE HEATING APPARATUS

TECHNICAL FIELD

The present invention relates to a fluid circulation type heating apparatus which circulates a fluid by heating and cooling the fluid and, more specifically, to a fluid circulation type heating apparatus from which a backflow prevention means such as a check valve or the like is easily detachable.

BACKGROUND ART

An electric blanket, an electric pad or the like is mainly used as an auxiliary heating means for heating a residential space. However, in the case of an electric device such as an electric blanket, an electric pad or the like, electric fields and electromagnetic waves are generated from an electric heating wire through which an electric current flows. Continuous exposure to the electromagnetic waves is harmful to a human body.

In an effort to reduce direct or indirect damage caused by the electromagnetic waves generated from the conventional electric blanket, the conventional electric pad or the like, there has been proposed a fluid circulation type heating apparatus in which a hot fluid is circulated through a pipe surrounded by a heat radiation member such as a blanket, a pad or the like.

For example, Korean Patent Nos. 1038576, 0312643 and 1033668 disclose a fluid circulation type heating apparatus in which a fluid heated by a pipe line heater or the like is circulated through the use of a circulation pump and a fluid circulation type heating apparatus in which a liquid is circulated using a pressure generated by the vaporization of the liquid.

PRIOR ART DOCUMENTS

Korean Patent No. 1038576
Korean Patent No. 0312643
Korean Patent No. 1033668

SUMMARY OF THE INVENTION

Technical Problems

The conventional fluid circulation type heating apparatuses described above suffer from the following problems. In the conventional fluid circulation type heating apparatuses, one or more backflow prevention means are installed in a fluid circulation line in order to assure that the fluid is circulated in one direction. However, the operation of the backflow prevention means may be hindered by an extraneous material generated when water mainly used as a fluid is heated for a long period of time, or the backflow prevention means may be degraded due to the long time use of the heating apparatus. In this case, there is posed a problem in that the fluid is not normally circulated. Since the heating apparatus should be dismantled in order to replace the backflow prevention means, it is very inconvenient to perform the replacement of the backflow prevention means. Thus, a large amount of repair cost may be generated. The trouble of the backflow prevention means may lead to the waste of the heating apparatus itself. This poses a problem in that the waste of resources becomes severe.

In view of the problems mentioned above, it is an object of the present invention to provide a novel fluid circulation type heating apparatus of a structure in which a backflow prevention means is easily replaceable.

Means for Solving the Problems

With the aforementioned object in view, a fluid circulation type heating apparatus according to the present invention includes: a circulation line; a heat radiation member installed on the circulation line; a boiler configured to heat and expand a fluid; a storage tank configured to store the fluid and to supply the fluid to the boiler; a controller configured to control the boiler; and a housing configured to accommodate the boiler and the controller, wherein the apparatus further comprises: a backflow prevention means removably installed in the housing and configured to, when mounted to the housing, communicate with the circulation line disposed between the boiler and the storage tank, the backflow prevention means configured to allow the fluid to flow in one direction through the circulation line.

The aforementioned apparatus may further include: a cap including a fixing portion removably coupled to the housing and a backflow prevention means installation portion having an entrance connected to the circulation line existing at the side of the storage tank, an exit connected to the circulation line exiting at the side of the boiler and an accommodation space formed between the entrance and the exit to accommodate the backflow prevention means, the backflow prevention means installed in the backflow prevention means installation portion of the cap. In this regard, the fixing portion may be threadedly coupled or fitted to the housing.

In the aforementioned apparatus, the storage tank may be detachably attached to the housing and may be provided with an outflow hole through which the fluid flows out, the housing including a backflow prevention means installation portion having an entrance communicating with the outflow hole, an exit connected to the circulation line existing at the side of the boiler and an accommodation space formed between the entrance and the exit to accommodate the backflow prevention means, the backflow prevention means removably installed in the backflow prevention means installation portion through the entrance.

The storage tank may be detachably attached to the housing and may be provided with an outflow hole through which the fluid flows out, the backflow prevention means installed within the outflow hole. In this regard, the storage tank may include an outer wall configured to define an internal space for accommodating the fluid, an opening formed in a bottom surface of the outer wall, a protrusion portion protruding downward along an outer circumferential surface of the opening, and a backflow prevention means installation member disposed in an installation space surrounded by the protrusion portion, the backflow prevention means installation member having an outflow hole through which the fluid flows out, the backflow prevention means installed within the outflow hole.

The housing may include a storage tank installation portion, the storage tank installation portion including a recess portion and a projection portion formed within the recess portion so as to have a shape corresponding to the outflow hole, the projection portion having an inlet port connected to the circulation line existing at an upstream side of the boiler and configured to communicate with the outflow hole.

In this regard, an outlet port connected to the circulation line existing at the side of the heat radiation member may be formed on a bottom surface of the recess portion, and an inflow hole, into which the fluid supplied through the outlet port flows, may be formed in the backflow prevention means installation member. The inflow hole may include a plurality of inflow holes formed around the outflow hole. A trench, through which the fluid supplied through the outlet port circulates, may be formed on a bottom surface of the recess portion, and the inflow hole may be connected to the trench.

The backflow prevention means installation member may be made of an elastic polymer material.

In the aforementioned apparatus, the boiler may include a boiler drum having an entrance and an exit connected to the circulation line, the exit positioned at a lowermost end of the boiler drum. The boiler drum may be installed in the housing in a tilted state so that the exit is positioned lower than the entrance.

The boiler may include a boiler drum provided with a single pipe which allows inflow and outflow of the fluid, the pipe connected to the circulation line existing at an upstream side of the boiler and the circulation line existing at a downstream side of the boiler, the backflow prevention means configured to prevent the fluid from flowing out through the circulation line existing at the upstream side of the boiler.

In the aforementioned apparatus, the storage tank may include an outflow hole through which the fluid flows out, and the backflow prevention means may be removably installed within the outflow hole.

In this regard, the storage tank may further include an outer wall configured to define an internal space for accommodating the fluid, an opening formed in the outer wall, a lid removably coupled to the opening and a rod extending from the lid, the rod provided at a free end with a backflow prevention means installation portion for accommodating the backflow prevention means, the rod including a flow path communicating at one end with the backflow prevention means installation portion and at the other end with the internal space, the flow path configured to deliver the fluid existing within the internal space to the backflow prevention means installation portion.

The aforementioned apparatus may further include: a flow velocity adjustment means made of a porous material, the flow velocity adjustment means installed within the circulation line between the boiler and the storage tank and configured to limit a flow velocity of the fluid supplied from the storage tank to the boiler.

Effects of the Invention

The fluid circulation type heating apparatus according to the present invention has an advantage in that the backflow prevention means is easily replaceable. Accordingly, it is possible for a general user to personally replace the backflow prevention means. This makes it possible to readily cope with sudden occurrence of trouble in the fluid circulation type heating apparatus and to prolong the lifespan of the fluid circulation type heating apparatus.

MODE FOR CARRYING OUT THE INVENTION

Figure 1:
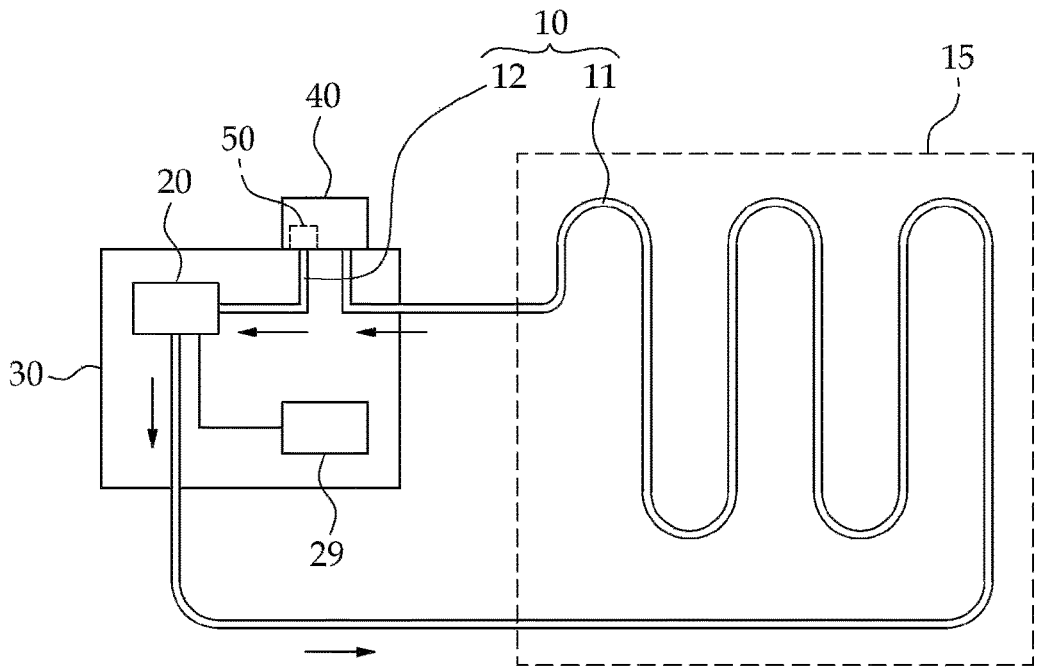
FIG. 1 is a conceptual diagram of a fluid circulation type heating apparatus according to one embodiment of the present invention.

Embodiments of the present invention will now be described in detail with reference to the accompanying drawings. However, the embodiments of the present invention may be modified in many different forms. It shall not be construed that the scope of the present invention is limited to the embodiments described below. The embodiments of the present invention are presented in order to offer thorough descriptions to a person having an ordinary knowledge in the field to which the present invention pertains. Thus, the shape of components illustrated in the drawings may be exaggerated in order to provide clear descriptions. Components designated by like reference symbols in the drawings are the same components.

FIG. 1 is a conceptual diagram of a fluid circulation type heating apparatus according to one embodiment of the present invention. Referring to FIG. 1, the fluid circulation type heating apparatus according to one embodiment of the present invention includes a circulation line 10 through which a fluid circulates, a heat radiation member 15 installed in the circulation line 10, a boiler 20 configured to heat the fluid, a controller 29 configured to control the boiler 20, a housing 30 in which the boiler 20 and the controller 29 are installed, and a storage tank 40 configured to accommodate the fluid.

The circulation line 10 is an elongated pipe through which the fluid circulates. The circulation line 10 includes a first circulation line 11 that forms a route in which a hot fluid discharged from the boiler 20 is cooled by the heat radiation member 15 and is then supplied to the storage tank 40, and a second circulation line 12 that forms a route in which a fluid discharged from the storage tank 40 is supplied to the boiler 20.

A flow velocity control means (not shown) may be installed within the first circulation line 11. The flow velocity control means may be made of a porous material, for example, a non-woven fabric or the like. The flow velocity control means serves to limit the flow velocity of the fluid supplied from the storage tank 40 to the boiler 20 through the second circulation line 12, thereby minimizing generation of noises which may be generated due to the fast flow of the fluid.

A portion of the circulation line 10 is disposed within the heat radiation member 15 in a meandering form and the remaining portion of the circulation line 10 is disposed outside the heat radiation member 15. The boiler 20, the storage tank 40 and the like are installed in the circulation line 10 disposed outside the heat radiation member 15.

The housing 30 has a substantially box-like shape. The boiler 20, a portion of the circulation line 10 and the controller 29 are installed within the housing 30. A storage tank installation portion 31 for installing the storage tank 40 is disposed above the housing 30.

Figure 2:
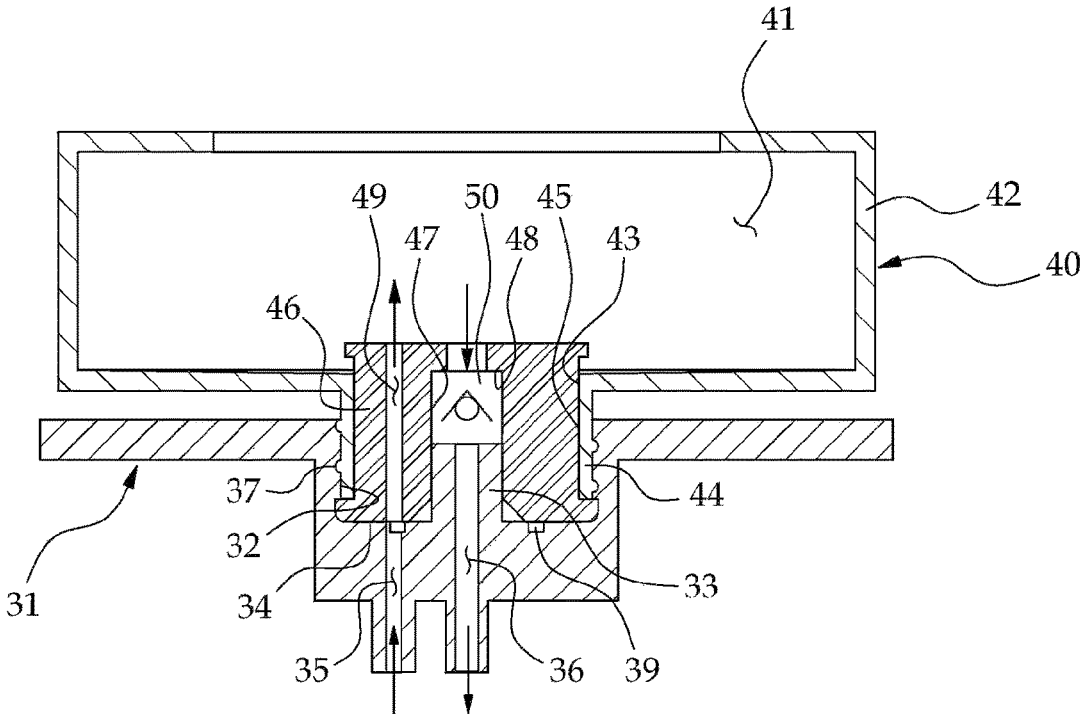
FIG. 2 is a sectional view illustrating some portions of the fluid circulation type heating apparatus illustrated in FIG. 1.
Figure 3:
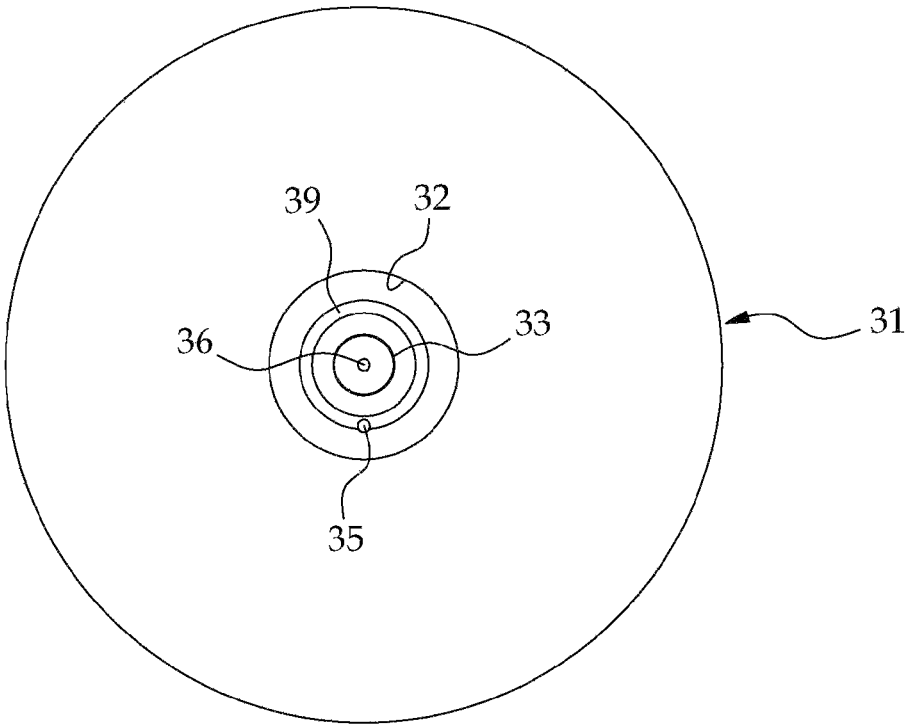
FIG. 3 is a plane view illustrating a storage tank installation portion of the fluid circulation type heating apparatus illustrated in FIG. 1.

FIG. 2 is a sectional view illustrating some portions of the fluid circulation type heating apparatus illustrated in FIG. 1. FIG. 3 is a plane view illustrating the storage tank installation portion of the fluid circulation type heating apparatus illustrated in FIG. 1. Referring to FIGS. 2 and 3, the storage tank installation portion 31 includes a recess portion 32 having a circular cross section, and a circular columnar projection portion 33 formed at the center of the recess portion 32. An outlet port 35 connected to the first circulation line 11 is formed on a bottom surface 34 of the recess portion 32. The outlet port 35 communicates with a concentric trench 39 formed on the bottom surface 34 of the outlet port 35. An inlet port 36 connected to the second circulation line 12 is formed in the projection portion 33.

The first circulation line 11 disposed between the housing 30 and the heat radiation member 15 is surrounded by a protection member (not shown) for preventing burn of a user and damage of the first circulation line 11.

A liquid such as water or oil may be used as the fluid. While not particularly limited, it is desirable to use deionized water. In this case, it is possible to restrain a backflow prevention means 50 from being broken down and to restrain the circulation line 10 from being clogged.

The heat radiation member 15 is used as a means for covering the first circulation line 11 and may be a blanket or a pad. The heat radiation member 15 serves to indirectly transfer the heat of the fluid flowing through the first circulation line 11 to a user. The heat radiation member 15 includes an inner fabric and an outer fabric. The first circulation line 11 is embedded within the inner fabric in a zigzag pattern. Examples of the method of embedding the first circulation line 11 within the inner fabric include a method of forming holes in the inner fabric at regular intervals in a zigzag pattern and inserting the first circulation line 11 into the holes in a sewing manner.

Figure 4:
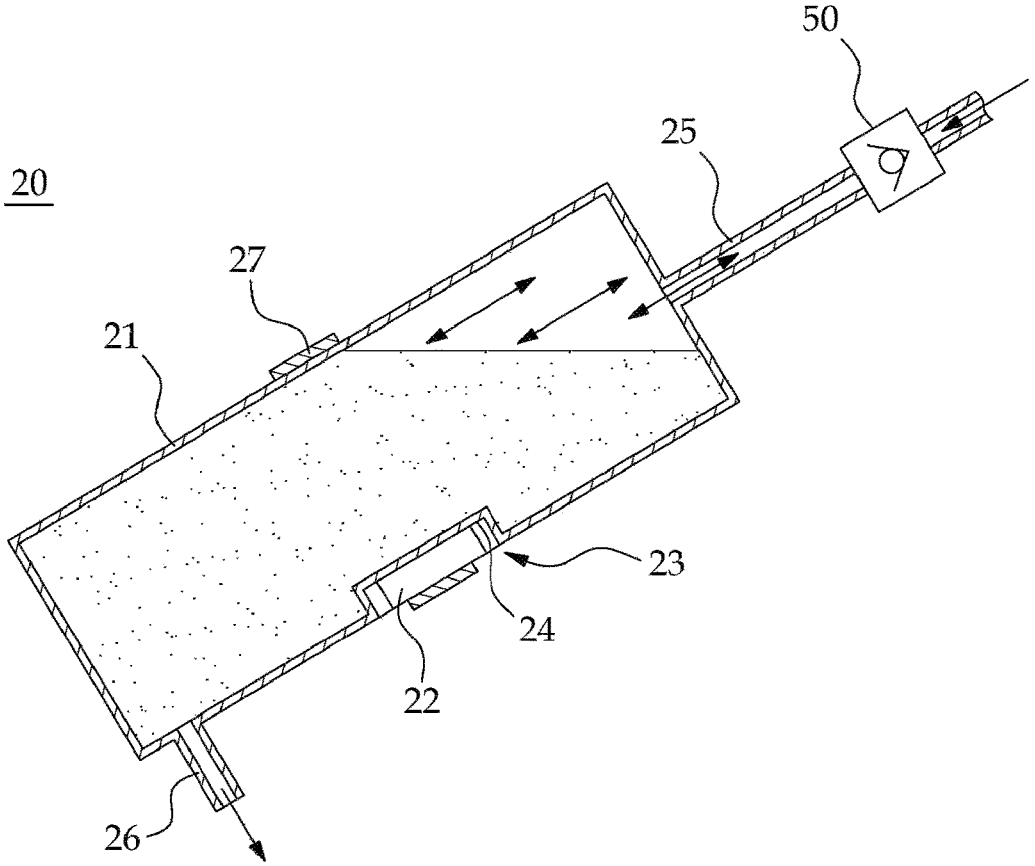
FIG. 4 is a side view of a boiler of the fluid circulation type heating apparatus illustrated in FIG. 1.

FIG. 4 is a side view of the boiler of the fluid circulation type heating apparatus illustrated in FIG. 1. The boiler 20 is installed in the circulation line 10 and is a means for heating the fluid flowing through the circulation line 10.

Referring to FIG. 4, the boiler 20 includes a boiler drum 21 and a plate heater 22. The boiler drum 21 has a substantially cylindrical shape. The boiler drum 21 includes a heater installation portion 23 having a planar surface 24 formed by flatly deforming the surface of the boiler drum 21 so as to facilitate the installation of the plate heater 22 and the heat transfer to the boiler drum 21. The boiler drum 21 includes an inlet port (or a boiler inlet port) 25 and an outlet port (or a boiler outlet port) 26 respectively coupled to the second circulation line 12 and the first circulation line 11. The boiler drum 21 is installed in the housing 30 in a tilted state so that the inlet port 25 is positioned higher than the outlet port 26. It is preferred that the outlet port 26 is formed at the lower side of the boiler drum 21. As illustrated in FIG. 4, if the fluid existing within the boiler 20 is heated and vaporized, the heated fluid is easily discharged toward the outlet port 26 by a gas pressure.

The boiler drum 21 is preferably made of a material having high heat conductivity. For example, the boiler drum 21 may be made of aluminum or copper.

Various kinds of methods may be used as a means for heating the boiler 20. For example, a nichrome heating wire may be wound around the outer wall of the boiler drum 21. Alternatively, a plate-shaped or rod-shaped heater may be installed in the boiler drum 21. Although the plate heater 22 is used as a heating means in the present embodiment, the heating means is not limited to the plate heater 22.

The plate heater 22 may be manufactured by forming a pattern serving as a resistor on one or both surfaces of a ceramic plate and then coating a protection layer, which serves to protect the resistor pattern, on the upper and lower surfaces of the ceramic plate. If an electric current is allowed to flow through the resistor pattern of the plate heater 22, heat is generated in the plate heater 22.

The boiler 20 further includes a clamp 27 for fixing the plate heater 22 to the boiler drum 21. If the clamp 27 is removed, it is possible to easily detach the plate heater 22 from the boiler drum 21. This makes it possible to easily cope with the trouble of the plate heater 22.

The heat transferred to the boiler drum 21 serves to heat the fluid introduced into the boiler drum 21, thereby expanding and vaporizing a part of the fluid. If the fluid is expanded or vaporized, the internal pressure of the boiler drum 21 grows higher and the fluid flows toward the outlet port 26 of the boiler drum 21. A backflow prevention means 50 is installed at the side of the inlet port 25 to cut off a backflow.

If the electric current flowing through the plate heater 22 is cut off, the heat is no longer transferred to the boiler drum 21. The boiler 20 is exposed to the outside except a portion of the surface thereof coupled to the plate heater 22. Since the boiler drum 21 is made of a material having high heat conductivity, the boiler drum 21 is rapidly cooled. Due to the cooling of the boiler drum 21, the vaporized fluid remaining within the boiler drum 21 is contracted again. The pressure is reduced due to the resultant volume reduction and the resultant vacuum formation. Thus, the fluid flows into the boiler drum 21 through the inlet port 25 of the boiler drum 21.

The controller 29 serves to apply an on-signal or an off-signal to a power source connected to the plate heater 22 according to a predetermined program. The fluid heating time and the fluid cooling time are adjusted by adjusting the duration of the on-signal and the duration of the off-signal. Upon heating the fluid, the temperature and pressure of the fluid increase. The increase in the pressure of the fluid enables the fluid to flow toward the heat radiation member 15. If the fluid existing within the boiler drum 21 is discharged from the outlet port 26 due to the vaporization pressure, the internal pressure of the boiler drum 21 generated during the vaporization of the fluid is not maintained. Thus, the fluid is introduced from the storage tank 40 into the boiler drum 21 again. At this time, a sudden pressure reduction is generated within the boiler drum 21 and the fluid is supplied into the boiler drum 21. Accordingly, the pumping speed and the fluid temperature can be controlled by adjusting the duration of the on-signal and the duration of the off-signal.

Referring again to FIG. 2, the storage tank 40 includes an outer wall 42 configured to define an internal space 41 for accommodating the fluid, a circular opening 43 formed in a bottom portion of the outer wall 42, and a protrusion portion 44 projecting downward along an outer circumferential surface of the opening 43. The storage tank 40 further includes a backflow prevention means installation member 46 disposed in an installation space 45 surrounded by the protrusion portion 44.

The backflow prevention means installation member 46 has a substantially circular columnar shape. An outflow hole 47 communicating with the inlet port 36 of the storage tank installation portion 31 so as to supply the fluid to the boiler 20 is formed in the central portion of the backflow prevention means installation member 46. A backflow prevention means 50 is installed within the outflow hole 47. The backflow prevention means 15 is a means for limiting the flow direction of the fluid so that the fluid flows only in one direction through the circulation line 10. That is to say, the backflow prevention means 50 is a means for preventing the fluid from flowing into the storage tank 40 through the outflow hole 47. As the backflow prevention means 50, it may be possible to use different kinds of check valves such as a ball check valve, a lift check valve, a swing check valve, a membrane check valve or the like. In the outflow hole 47, there may be formed a stopper 48 for preventing the backflow prevention means 50 from being pushed by the pressure.

If the backflow prevention means installation member 46 is made of a polymer material having elasticity such as a silicon rubber or the like, there is an advantage in that it is possible to fix the backflow prevention means 50 and to seal the space between the backflow prevention means 50 and the outflow hole 47 by merely inserting the backflow prevention means 50 into the outflow hole 47.

In the region of the backflow prevention means installation member 46 around the outflow hole 47, there are formed inflow holes 49 which communicate with the outlet port 35 of the storage tank installation portion 31 so that the cold fluid, which has transferred heat to the heat radiation member 15, can flow into the inflow holes 49. The number of the inflow holes 49 may be changed if such a need arises. The fluid flowing into the recess portion 32 through the outlet port 35 passes through the trench 39 of the bottom surface 34 of the recess portion 32 and the inflow holes 49 and then flows into the internal space 41 of the storage tank 40. The trench 39 is needed in order to smoothly secure a flow path when the storage tank 40 is rotationally coupled to the storage tank installation portion 31.

The storage tank 40 is threadedly coupled to the storage tank installation portion 31. At this time, the space between the wall surface of the recess portion 32 and the protrusion portion 44 is sealed. If necessary, an additional sealing means such as an O-ring or the like may be installed between the protrusion portion 44 and the recess portion 32.

When the storage tank 40 is threadedly coupled to the storage tank installation portion 31, the projection portion 33 of the storage tank installation portion 3 is fitted to the outflow hole 47 of the backflow prevention means installation member 46. Since the backflow prevention means installation member 46 has elasticity, it is possible to seal the space between the projection portion 33 and the outflow hole 47.

While not shown in the drawings, a level sensor capable of measuring a level of the fluid stored within the storage tank 40 may be installed in the storage tank 40. The level sensor serves to inform whether it is necessary to supplement the fluid.

Descriptions will now be made on the operation of the fluid circulation type heating apparatus according to one embodiment of the present invention.

First, the storage tank 40 containing deionized water is mounted to the storage tank installation portion 31 of the housing 30. At this time, the backflow prevention means 50 installed in the outflow hole 47 of the storage tank 40 is pressed against the inlet port 36 of the storage tank installation portion 31.

Upon operating the fluid circulation type heating apparatus, the plate heater 22 of the boiler 20 is actuated to heat the fluid stored within the boiler drum 21. The fluid thus heated is expanded and is partially vaporized. The expansion and vaporization of the fluid raise the internal pressure of the boiler drum 21 and pressurize the fluid exiting within the boiler drum 21. Since the backflow prevention means 50 is installed in the outflow hole 47 of the storage tank 40, the fluid existing within the boiler drum 21 cannot flow toward the inlet port 25 of the boiler drum 21 (toward the outflow hole of the storage tank) and flows toward the outlet port 26.

The fluid flowing toward the outlet port 26 flows along the first circulation line 11 disposed within the heat radiation member 15 and transfers heat to the heat radiation member 15. Thus the fluid is cooled. The fluid thus cooled comes back to the storage tank 40. In the case where the boiler is kept in a heated state, the fluid existing within the storage tank 40 cannot flow toward the boiler 20. This is because the internal pressure of the boiler 20 is higher than the internal pressure of the storage tank 40.

If the power source connected to the plate heater 22 of the boiler 20 is cut off or if the heat generation amount of the plate heater 22 is reduced, the interior of the boiler drum 21 is cooled by an external air. If the interior of the boiler drum 21 is sufficiently cooled and if the internal pressure of the boiler drum 21 becomes lower than the internal pressure of the storage tank 40, the fluid stored in the storage tank 40 is supplied into the boiler drum 21. The fluid flowing into the boiler drum 21 sharply reduces the internal temperature of the boiler drum 21 and, consequently, accelerates the inflow of the fluid. At this time, the flow velocity adjustment means installed within the second circulation line 12 reduces the inflow velocity of the fluid, thereby minimizing the noises generated in the course of inflow of the fluid.

If the plate heater 22 of the boiler drum 21 is actuated again, the fluid circulates through the process described above.

In the present embodiment, if the backflow prevention means 50 is broken, it is possible to easily replace the broken backflow prevention means 50 by replacing the storage tank 40 threadedly coupled to the housing 30 with a new storage tank 40. Since it is difficult for a general user to purchase deionized water, the user may manage the fluid circulation type heating apparatus by purchasing a new storage tank 40 containing deionized water and periodically replacing the old storage tank with the new one. In this case, it is possible to periodically replace the backflow prevention means 50 and to prevent trouble of the backflow prevention means 50.

Figure 5:
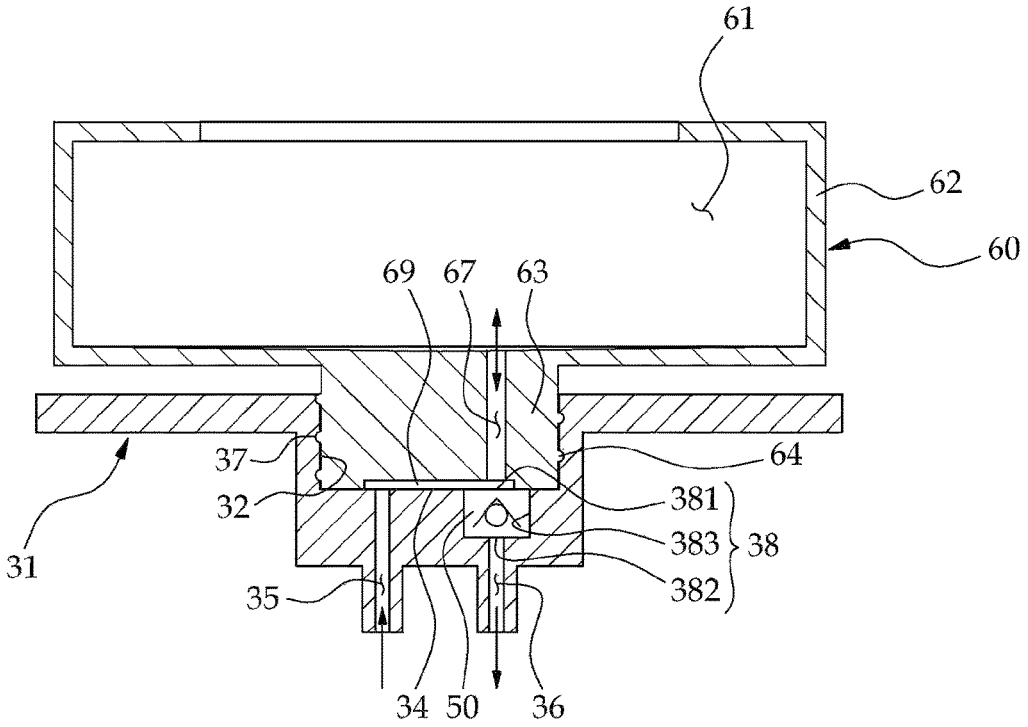
FIG. 5 is a sectional view illustrating some portions of a fluid circulation type heating apparatus according to another embodiment of the present invention.

FIG. 5 is a sectional view illustrating some portions of a fluid circulation type heating apparatus according to another embodiment of the present invention. In this embodiment, the backflow prevention means 50 is detachably attached to a backflow prevention means installation portion 38 of the storage tank installation portion 31.

In this embodiment, a storage tank 60 includes an outer wall 62 configured to define an internal space 61 for accommodating a fluid, and a coupling portion 63 protruding downward from a bottom surface of the outer wall 62. An external thread 64 to be threadedly coupled to the housing 30 is formed on the outer circumferential surface of the coupling portion 63. Furthermore, an inflow/outflow hole 67 communicating with the internal space 61 of the storage tank 60 is formed in the coupling portion 63. A depressed portion 69 having a circular cross section is formed at the free end of the coupling portion 63. The inflow/outflow hole 67 communicates with the depressed portion 69.

A recess portion 32 corresponding to the coupling portion 63 is formed in the storage tank installation portion 31. An internal thread 37 corresponding to the external thread 64 of the coupling portion 63 is formed on the inner surface of the recess portion 32. An outlet port 35 and a backflow prevention means installation portion 38, both of which are connected to the depressed portion 69 of the coupling portion 63, are formed in the bottom surface 34 of the recess portion 32.

The backflow prevention means installation portion 38 includes an entrance 381 communicating with the depressed portion 69 and an exit 382 communicating with the inlet port 36. An accommodation space 383 for accommodating the backflow prevention means 50 is formed between the entrance 381 and the exit 382.

In this embodiment, the backflow prevention means 50 can be mounted to or removed from the backflow prevention means installation portion 38 through the entrance 381 of the backflow prevention means installation portion 38 after removing the storage tank 60 from the housing 30. This embodiment has an advantage in that only the backflow prevention means 50 can be replaced instead of replacing the storage tank 60 as a whole.

In this embodiment, the fluid flowing into the depressed portion 69 through the outlet port 35 cannot flow toward the inlet port 36 due to the existence of the backflow prevention means 50. Thus, the fluid is stored within the internal space 61 of the storage tank 60 through the inflow/outflow hole 67. If the internal pressure of the boiler drum 21 is lowered, the fluid stored within the internal space 61 of the storage tank 60 flows into the boiler 20 via the second circulation line 12 after passing through the inflow/outflow hole 67, the depressed portion 69, the backflow prevention means 50 and the inlet port 36 in the named order.

Figure 6:
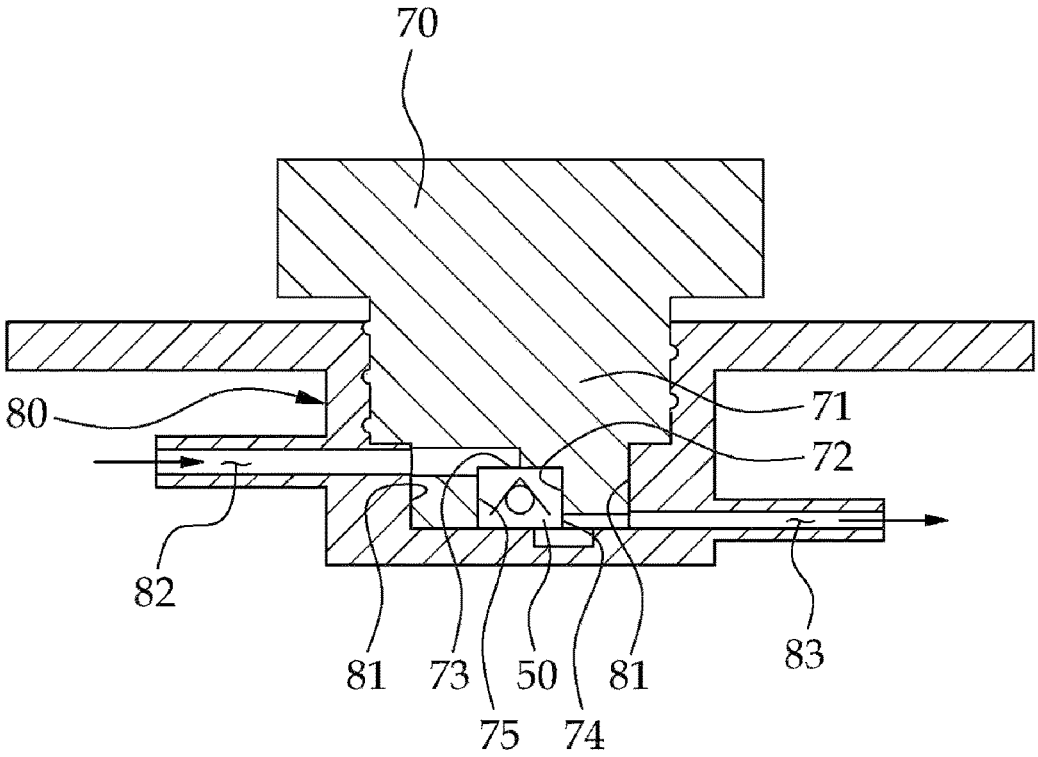
FIG. 6 is a sectional view illustrating some portions of a fluid circulation type heating apparatus according to a further embodiment of the present invention.

FIG. 6 is a sectional view illustrating some portions of a fluid circulation type heating apparatus according to a further embodiment of the present invention.

In this embodiment, the backflow prevention means 50 is installed by mounting a cap 70 provided with the backflow prevention means 50 to the housing 30. In this case, the cap 70 is positioned between the boiler 20 and the storage tank 60. As illustrated in FIG. 6, a cap installation portion 80, to which the cap 70 can be threadedly coupled, is formed in the housing 30. An inlet port 82 connected to the second circulation line 12 existing at the side of the storage tank 40 and an outlet port 83 connected to the second circulation line 12 existing at the side of the boiler 20 are formed in a wall surface 81 of the cap installation portion 80.

The cap 70 includes a fixing portion 71 threadedly coupled to the cap installation portion 80 and a backflow prevention means installation portion 72 extending from the fixing portion 71. The backflow prevention means installation portion 72 includes an entrance 73 connected to the inlet port 82 and an exit 74 connected to the outlet port 83. Furthermore, an accommodation space 75 for accommodating the backflow prevention means 50 is formed between the entrance 73 and the exit 74.

In this embodiment, the backflow prevention means 50 can be replaced by replacing the cap 70. Alternatively, the backflow prevention means 50 may be replaced by separating the cap 70 from the housing 30, removing the backflow prevention means 50 from the backflow prevention means installation portion 38 of the cap 70, and then installing another backflow prevention means 50 in the backflow prevention means installation portion 38.

Figure 7:
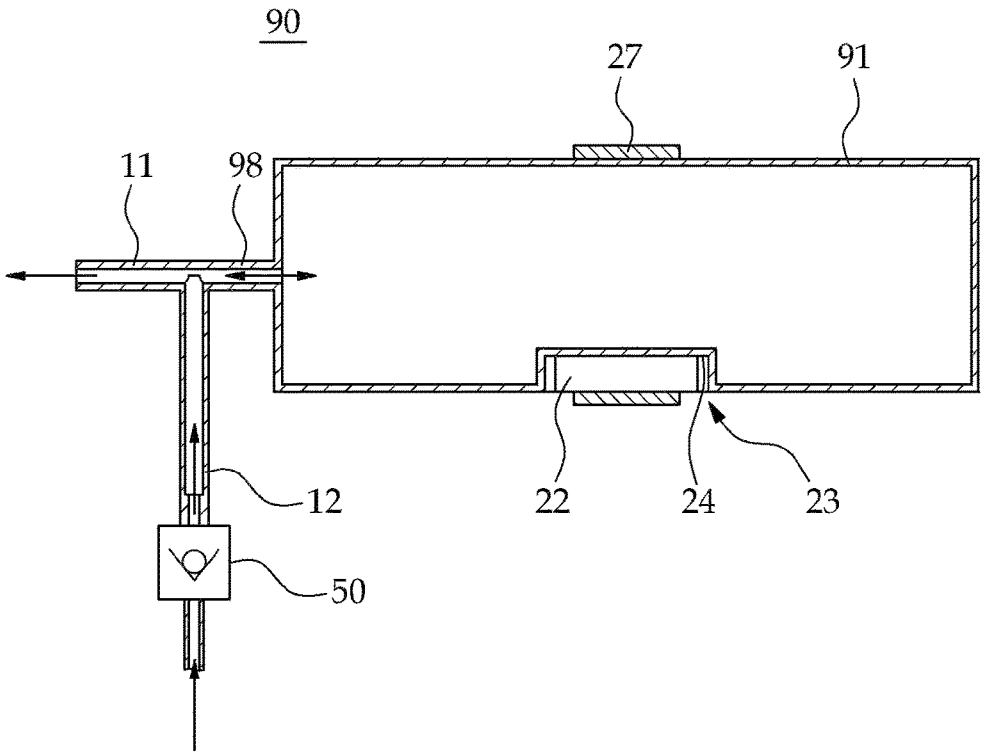
FIG. 7 is a side view of a boiler according to a modification.

FIG. 7 is a side view of a boiler according to a modification. Unlike the boiler 20 illustrated in FIG. 4, the boiler 90 illustrated in FIG. 7 is configured so that a fluid is introduced into and discharged from a boiler drum 91 through a single pipe 98 extending from one surface of the boiler drum 91. The first circulation line 11 and the second circulation line 12 connected to the storage tank 40 are connected to the pipe 98. In other words, the entrance and the exit are formed of the single pipe 98.

If the fluid existing within the boiler drum 91 is heated and partially vaporized by the plate heater 22, the heated fluid is discharged through the pipe 98 of the side surface of the boiler drum 91 under a gas pressure. Since the backflow prevention means 50 is installed at the side of the second circulation line 12 connected to the storage tank 40, the fluid does not flow toward the second circulation line 12 connected to the storage tank 40 but flows toward the first circulation line 11.

If the fluid existing within the boiler drum 91 is cooled, a negative pressure is generated within the boiler drum 91. Thus, the fluid flows into the boiler drum 91 through the second circulation line 12 connected to the storage tank 40 and the pipe 98 of the side surface of the boiler drum 91. At this time, the fluid existing within the storage tank 40 exposed to the atmospheric pressure flows into the boiler drum 91 in an amount larger than the amount of the fluid existing within the first circulation line 11.

Figure 8:
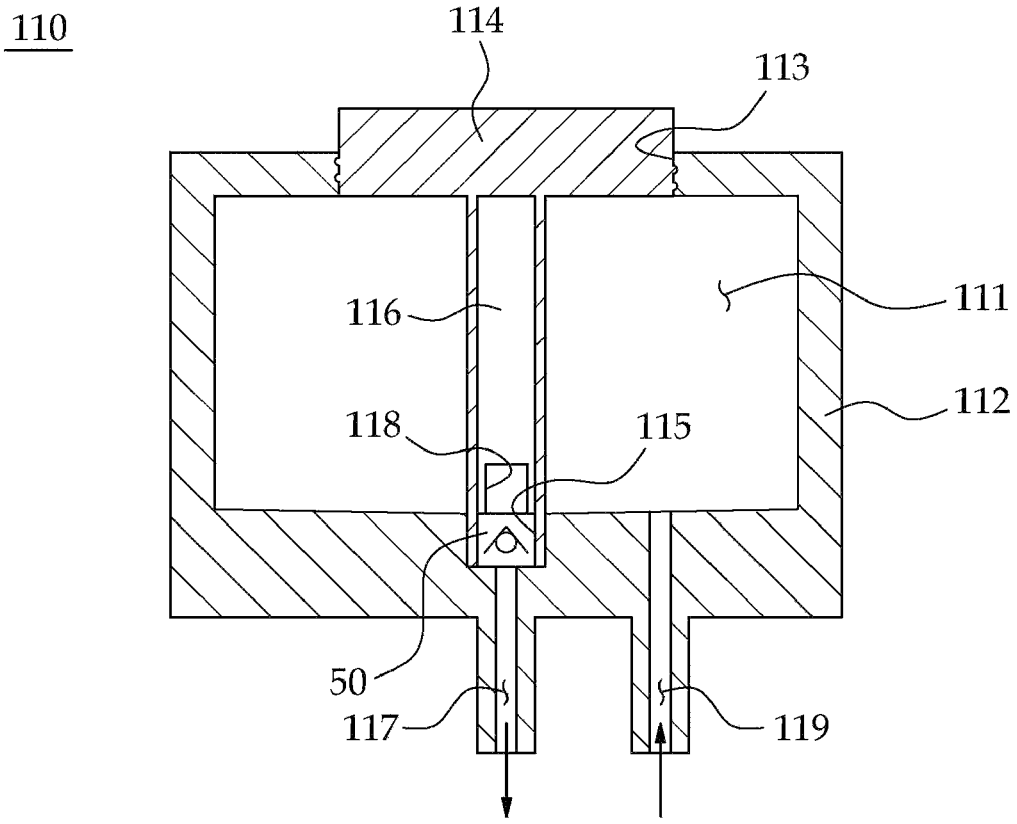
FIG. 8 is a sectional view illustrating a storage tank of a fluid circulation type heating apparatus according to a still further embodiment of the present invention.

FIG. 8 is a sectional view illustrating a storage tank of a fluid circulation type heating apparatus according to a still further embodiment of the present invention.

A storage tank 110 according to this embodiment includes an outer wall 112 configured to define an internal space 111 for accommodating a fluid, and an outflow hole 117 and an inflow hole 119 formed in a bottom surface of the outer wall 112. The end portion of the outflow hole 117 existing at the side of the internal space 111 is larger in cross-sectional area than the remaining portion of the outflow hole 117 so that the backflow prevention means 50 can be installed in the outflow hole 117.

Furthermore, an opening 113 is formed in a top surface of the outer wall 112 of the storage tank 110. A lid 114 is threadedly coupled to the opening 113. A rod 116 is connected to the lid 114. A backflow prevention means 50 is installed at the free end of the rod 116. The backflow prevention means 50 is installed in a backflow prevention means installation portion 115 formed at the free end of the rod 116. The backflow prevention means installation portion 115 is formed in a hollow shape so that the backflow prevention means 50 can be installed at the free end of the rod 116. A flow path 118 for supplying the fluid to the backflow prevention means 50 is formed in the rod 116. One end of the flow path 118 communicates with the central space of the rod 116 in which the backflow prevention means 50 is installed. The other end of the flow path 118 faces toward the internal space 111 of the storage tank 110.

In this embodiment, the backflow prevention means 50 can be easily replaced by replacing the lid 114.

The embodiments described above are nothing more than some preferred embodiments of the present invention. The scope of the present invention is not limited to the embodiments described above. A person having an ordinary knowledge in this field will be able to make different changes, modifications or substitutions without departing from the spirit of the present invention defined in the claims. It is to be understood that such changes, modifications or substitutions fall within the scope of the present invention.

In the embodiment illustrated in FIG. 2, there has been described an example in which the fluid circulation type heating apparatus includes a separate backflow prevention means installation member 46. However, the backflow prevention means installation member may be one-piece formed with the storage tank. Furthermore, there has been described an example in which the backflow prevention means installation member is made of an elastic polymer material. Alternatively, the backflow prevention means installation member may be made of a hard material and may be sealed by fitting the same. It may be possible to use an additional sealing means such as an O-ring or the like.

In the embodiment illustrated in FIG. 6, there has been described an example in which the entrance and the exit of the backflow prevention means installation portion are arranged side by side. However, it will be apparent that the entrance and the exit may be orthogonal to each other depending on the kind of the backflow prevention means.

Furthermore, in the embodiment illustrated in FIG. 8, the backflow prevention means may be directly installed in the outflow hole.

DESCRIPTION OF REFERENCE NUMERALS

10: circulation line, 15: heat radiation member, 20, 90: boiler, 21, 91: boiler drum, 22: plate heater, 23: heater installation portion, 27: clamp, 29: controller, 30: housing, 31: storage tank installation portion, 32: recess portion, 33: projection portion, 35: outlet port, 36: inlet port, 38, 72, 115: backflow prevention means installation portion, 40, 60, 110: storage tank, 41, 61, 111: internal space, 42, 62, 112: outer wall, 43: opening, 44: protrusion portion, 46: backflow prevention means installation member, 47, 97: outflow hole, 49,99: inflow hole, 50: backflow prevention means, 63: coupling portion, 67: inflow/outflow hole, 69: depressed portion, 70: cap, 71: fixing portion, 80: cap installation portion, 114: lid, 116: rod

What is claimed is:

1. A fluid circulation type heating apparatus comprising:

a circulation line;

a heat radiation member installed on the circulation line;

a boiler configured to heat and expand a fluid;

a controller configured to control the boiler;

a housing enclosing the boiler and the controller and including a storage tank installation portion at a wall thereof;

a storage tank configured to store the fluid and to supply the fluid to the boiler and detachably mounted to the storage tank installation portion of the housing such that the storage tank is disposed outside the housing, the storage tank including an opening formed at a wall of the storage tank; and a backflow prevention means installation member installed in the opening of the storage tank such that when the storage tank is installed on the housing, the backflow prevention means installation member is disposed between the storage tank and the housing, and the backflow prevention means installation member including an inflow hole formed through the backflow prevention means installation member, and through which the fluid flows into the storage tank, and an outflow hole through which the fluid flows out of the storage tank, wherein a backflow prevention means is installed in the outflow hole of the backflow prevention means installation member such that the backflow prevention means allows the fluid to flow in one direction.

2. The apparatus of claim 1, wherein the storage tank further includes a protrusion portion protruding from the storage tank along an outer circumferential surface of the opening.

3. The apparatus of claim 2, wherein the storage tank installation portion includes a recess portion into which the protrusion portion of the storage tank and the backflow prevention means installation member are inserted, and a projection portion formed within the recess portion such that the projection portion is inserted into the outflow hole of the backflow prevention means installation member, wherein the projection portion has an inlet port such that the inlet port is configured to communicate with the outflow hole.

4. The apparatus of claim 3, wherein an outlet port is formed at the recess portion, and the outlet port is configured to communicate with the inflow hole.

5. The apparatus of claim 4, wherein a trench, through which the fluid supplied through the outlet port circulates, is formed on a surface of the recess portion.

6. The apparatus of claim 1, wherein the backflow prevention means installation member is made of an elastic polymer material.

7. The apparatus of claim 1, wherein the boiler includes a boiler drum having a boiler inlet port and a boiler outlet port connected to the circulation line, the boiler outlet port being positioned at a lowermost end of the boiler drum.

8. The apparatus of claim 7, wherein the boiler drum is installed in a tilted state so that the boiler outlet port is positioned lower than the boiler inlet port.

9. The apparatus of claim 1, wherein the boiler includes a boiler drum provided with a single pipe which allows inflow and outflow of the fluid, the pipe connected to the circulation line existing at an upstream side of the boiler and the circulation line existing at a downstream side of the boiler, the backflow prevention means configured to prevent the fluid from flowing out through the circulation line existing at the upstream side of the boiler.

* * * * *